US011553777B2

(12) United States Patent
Thorez et al.

(10) Patent No.: US 11,553,777 B2
(45) Date of Patent: Jan. 17, 2023

(54) INSERT FOR THE COVER OF A VIAL FOR DISPENSING A FLUID PRODUCT, COVER EQUIPPED WITH THE INSERT AND ASSOCIATED VIAL

(71) Applicant: Albea Services, Gennevilliers (FR)

(72) Inventors: Gael Thorez, Voisins le Bretonneux (FR); Laurent Pesqueux, Teloché (FR); Philippe Paris, Ecommoy (FR)

(73) Assignee: Albea Services, Gennevilliers (FR)

( * ) Notice: Subject to any disclaimer, the term of this patent is extended or adjusted under 35 U.S.C. 154(b) by 190 days.

(21) Appl. No.: 16/659,549

(22) Filed: Oct. 21, 2019

(65) Prior Publication Data

US 2021/0112944 A1 Apr. 22, 2021

(30) Foreign Application Priority Data

Oct. 19, 2019 (FR) ..... 1859692

(51) Int. Cl.
*B65D 51/24* (2006.01)
*A45D 34/02* (2006.01)
*A45D 34/00* (2006.01)

(52) U.S. Cl.
CPC ..... *A45D 34/02* (2013.01); *B65D 51/24* (2013.01); *A45D 2034/002* (2013.01)

(58) Field of Classification Search
CPC ..... B65D 51/24; B65D 83/00; B05B 11/3047; B05B 11/0032; A45D 34/02; A45D 2034/002; A45D 3034/007
USPC ..... 215/2
See application file for complete search history.

(56) References Cited

U.S. PATENT DOCUMENTS 2,500,687 A * 3/1950 Kamp ..... A45D 40/0075 222/48
4,746,017 A * 5/1988 Howard ..... B65D 77/0486 206/438
6,105,799 A * 8/2000 Takagawa ..... A47J 41/026 215/12.1
6,742,665 B2 * 6/2004 Lombardo ..... A61J 9/04 215/11.5
6,926,175 B2 * 8/2005 Choi ..... A45D 34/00 222/321.7
6,955,278 B2 * 10/2005 Lorscheidt ..... B05B 11/007 222/320

(Continued)

FOREIGN PATENT DOCUMENTS

GB 2512412 10/2014

*Primary Examiner* — Ernesto A Grano
(74) *Attorney, Agent, or Firm* — CRGO Global; Steven M. Greenberg

(57) ABSTRACT

The invention relates to a cover intended to close a vial for dispensing a fluid product, the cover including a hollow body and an insert inserted in the hollow body. The insert includes a platform including an upper face delimited by a peripheral edge and featuring a central axis;

a skirt extending along the central axis from the platform and featuring an outer surface;

an empty volume defined by:

a base corresponding to a surface of the upper face included between, on the one hand, the peripheral edge and, on the other, a joint between the platform and the outer surface of the skirt, and a height corresponding to the height of the skirt;

The insert further includes the means for filling the empty volume.

12 Claims, 7 Drawing Sheets

(56) References Cited

U.S. PATENT DOCUMENTS

| | | | | |
|---|---|---|---|---|
| 8,783,490 | B2 * | 7/2014 | Gupta | A47J 36/027 220/23.87 |
| 9,392,857 | B2 * | 7/2016 | Jung | B05B 11/3047 |
| 10,835,011 | B2 * | 11/2020 | Noh | A45D 34/00 |
| 2007/0164053 | A1 | 7/2007 | Son | |
| 2008/0169312 | A1 * | 7/2008 | Kee | B65D 83/0033 222/205 |
| 2009/0218008 | A1 * | 9/2009 | Law | B05B 11/3094 141/311 R |
| 2011/0174835 | A1 | 7/2011 | Mamiye | |
| 2019/0193899 | A1 | 6/2019 | Van Der Molen | |

* cited by examiner

INSERT FOR THE COVER OF A VIAL FOR DISPENSING A FLUID PRODUCT, COVER EQUIPPED WITH THE INSERT AND ASSOCIATED VIAL

CROSS REFERENCE TO RELATED APPLICATIONS

This application claims priority under 35 U.S.C. § 119(a) to French patent application number 1859692, filed on Oct. 19, 2018, the entire teachings of which are incorporated herein by reference.

BACKGROUND OF THE INVENTION

Field of the Invention

The present invention relates to an insert intended to equip a cover of a vial for dispensing a fluid product and more particularly to a cover equipped with such an insert.

Description of the Related Art

Covers of vials for dispensing a cosmetic product are perceived by users as elements that inform as to the market value of the product, and so a certain weight is associated with a given perceived value. The covers of vials containing luxury products have therefore been made heavier, in order to meet the expectations of users in terms of the perceived value of the product.

A cover has been proposed including a hollow body, an insert against which the hollow body is intended to bear, and a weight element configured to be housed between the hollow body and the insert. In this type of cover, the weight element is made of reinforced plastic that gives it some weight. However, the time it takes to inject the plastic in the cavity of the manufacturing mold is relatively long and the final product is not sufficiently heavy: this solution is costly and limited in terms of the value actually perceived by the user. Furthermore, thick plastic parts often feature visible defects on their surface, in this case shrinkage cavities resulting from difficulties relating to the mold-filling process. A good surface state, including of non-visible parts, is, however, necessary in terms of user satisfaction.

An alternative solution is to insert a weight element made of a high-density material, such as steel or Zamak, between the body of the cover and the insert. However, it is impossible for such a weight element to occupy the entire volume between the cover and the insert: on the one hand, the cover would be too heavy, and on the other hand, the cost of the material of the weight element would drastically increase the price of the cover. Therefore, the solution that is generally chosen resides in the insertion of an annular weight element between the insert and the cover. This solution helps overcome the abovementioned problems: the cover has a good weight (neither too light, nor to heavy), leading the user to "perceive value", it can be achieved at an acceptable cost, and the weight element does not slow down the manufacturing process.

However, a large empty volume still remains within the cover. This volume cannot be seen, but it is indirectly perceptible to the user, because the cover "sounds hollow" when the user taps it with their finger. The "perceived value" is therefore lowered.

BRIEF SUMMARY OF THE INVENTION

In this context, the invention relates to a cover intended to close a vial for dispensing a fluid product, the cover including a hollow body and an insert inserted in the hollow body, the insert including:

a platform including an upper face delimited by a peripheral edge and featuring a central axis;

a skirt extending along the central axis from the platform and featuring an outer surface;

an empty volume defined by:

a base corresponding to a surface of the upper face included between, on the one hand, the peripheral edge and, on the other, a joint between the platform and the outer surface of the skirt, and a height corresponding to the height of the skirt;

the insert further including the means to fill the empty volume.

The cover according to the invention therefore includes an insert, which, once inserted inside the hollow body, fills the empty volume inside the hollow body. Indeed, the insert includes a platform with a central axis that serves as a base for a cylindrical skirt extending along the central axis from the platform. The skirt serves as a support for the means to fill the empty volume. These filling means absorb and block the sound waves coming from the cover when the user taps the cover with their finger, which significantly reduces the "hollow sound" that occurs in the absence of the filling means. They produce instead a "muffled" sound which is more pleasant to the ears of the user.

According to different characteristics of the invention, which can be taken together or separately:

the skirt is cylindrical;

the means for filling the empty volume consist of ribs that extend from the outer surface of the skirt;

the means for filling the empty volume generally consist of two parallel and diametrically opposed walls that extend radially from the outer surface of the skirt along a plane intersecting on the axis with a plurality of ribs extending from the parallel walls;

the ribs are parallel with one another;

the ribs are evenly distributed over the entire periphery of the skirt and along the parallel walls;

the ribs are, two by two, separated by a distance $d_1$ ranging from 2 to 4 mm;

the ribs have a thickness ranging from 1 to 3 mm, preferably from 1.5 to 2.5 mm;

the ribs are separated from the platform;

two ribs are located at 90° from the parallel walls and are connected to the platform by a tapered section;

the ribs extend over the entire height of the skirt;

the parallel walls extend from the platform through a tapered section;

the insert includes a cylindrical conduit extending from the platform and featuring a central housing for receiving a pump;

the skirt extends coaxially about the conduit;

the conduit has the same height as the skirt;

the conduit is closed at its upper free end;

a filling rate of the empty volume through the filling means ranges from 10% to 80%, preferably from 20% to 40%;

the insert is molded as a single part.

The invention also relates to a cover intended to close a vial for dispensing a fluid product, the cover including a hollow body, the hollow body being provided with an insert such as described above.

The hollow body is also equipped with a weight element inserted between the conduit and the skirt of the insert.

Finally, the invention relates to a vial for dispensing a fluid product equipped with a cover such as described above.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
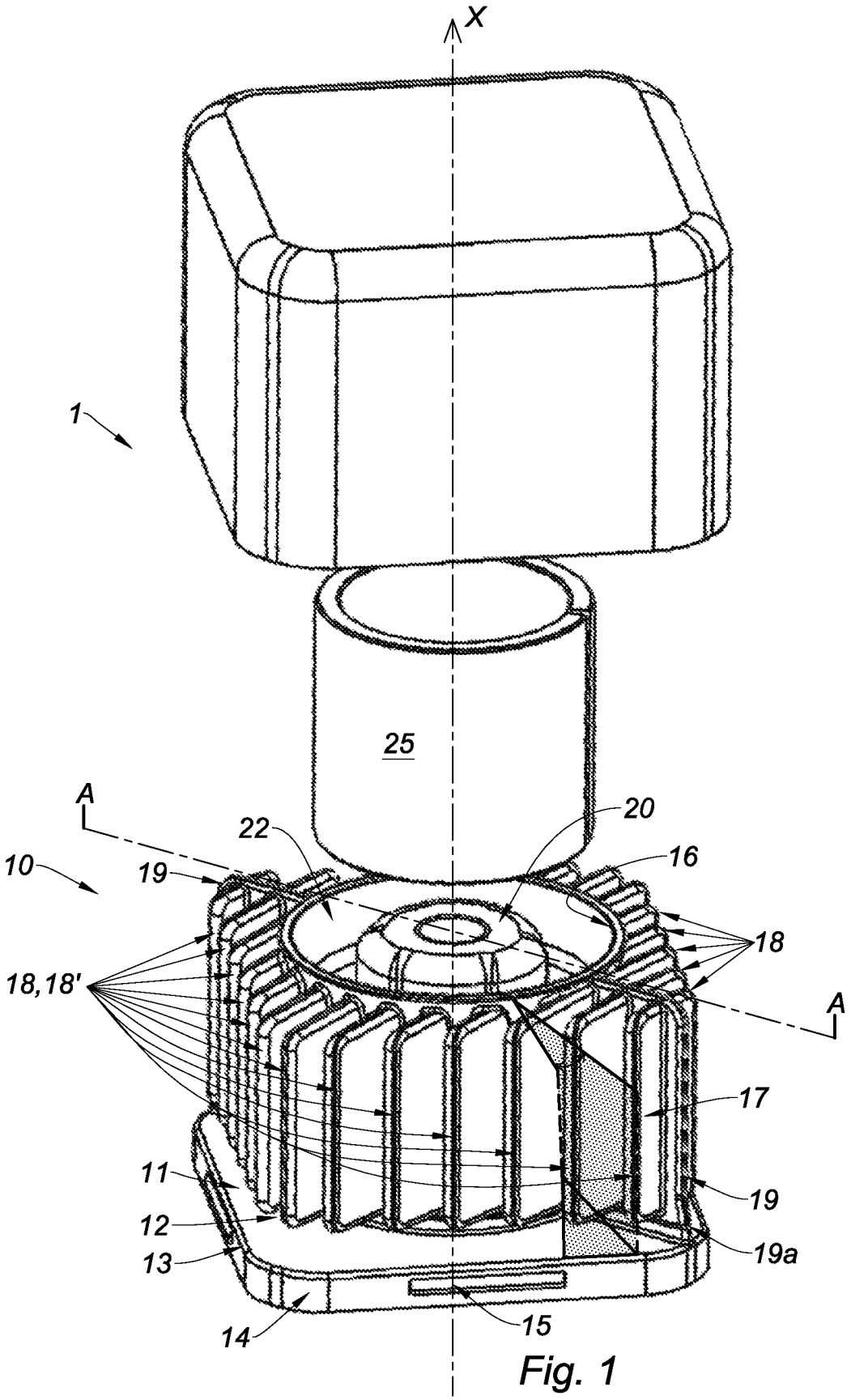
FIG. 1 is an exploded and perspective view of a cover according to the invention, including a hollow body, an insert and a weighted element.

FIG. 1 shows a cover of a vial for dispensing a fluid product according to the invention. The vial includes a reservoir, a system for dispensing a fluid product connected to the reservoir (not shown) and the cover.

The fluid product is a cosmetic product, more particularly a perfume, an eau de toilette or a fragrance.

The fluid product is contained in the reservoir. Conventionally, the reservoir includes, in its top part, a rigid neck delimiting an opening in which is inserted the system for dispensing the fluid product. The dispensing system includes attachment and sealing means that maintain the dispensing system permanently at the level of the neck, to isolate the reservoir from the surrounding environment and preserve all the properties of the fluid product. The dispensing system further includes a pump that can be actuated by a user with a push button, in order to spray a dose of the fluid product.

The reservoir and the cover are the only two parts that can be seen from the outside by the user. They must therefore be aesthetically appealing and have a weight that is associated with the value of the dispensed product, while also reflecting the brand of the product.

FIG. 1 shows an exploded view of a cover, so that its different components can be identified. The cover includes a hollow body 1, an insert 10, and a weight element 25. The weight element 25 is inserted in a dedicated housing in the insert 10, and the insert 10 and weight element 25 assembly is then mounted inside the hollow body 1.

When the cover is assembled, the hollow body 1 conceals the insert 10 and the weight element 25. In other words, the hollow body 1 represents the outer shell of the cover and is therefore immediately visible to the user. It extends in the three dimensions of space and includes an empty inner volume intended to receive the insert 10. In this case, it has a square shape with rounded edges. However, the shape and external aspect of the hollow body 1 do not directly relate to the invention.

The insert 10 occupies an adequate surface within the hollow body 1, i.e. it is integrally included within the hollow body 1 so that the insert 10 is concealed by the hollow body 1 once the cover has been assembled, as mentioned above.

The insert 10 includes a platform 11 with a central axis X and an upper face 12. Preferably, the platform 11 is substantially planar, as is its upper face 12. Preferably, it includes a lower face (not shown), and a peripheral side 14 oriented perpendicular to the upper 12 and lower faces. The upper face 12 is delimited by a peripheral edge 13. This peripheral edge 13 coincides with a delimitation line between the upper face 12 and the peripheral side 14. The peripheral edge 13 has a profile that matches that of the hollow body. Advantageously, it fits with the outline of the hollow body 1. This is particularly convenient and facilitates the insertion and attachment of the insert 10 inside the hollow body 1. The lower face (not shown) is the face that is visible to the user.

Furthermore, the insert 10 preferably includes means 15 for snap-fitting the hollow body 1 onto the insert 10. These snap-fitting means 15 are located at the level of the peripheral side 14. They consist of protrusions intended to engage in a dedicated groove provided inside the hollow body 1. The parts including the protrusions or the grooves are interchangeable. Preferably, the snap-fitting means are provided in sufficient numbers and are adequately distributed over the entire periphery of the peripheral edge 14, in order to ensure a long-lasting attachment of the insert 10 in the hollow body 1. However, other attachments means for the insert 10 known to the person skilled in the art can be provided in the hollow body 1.

The insert 10 also includes a cylindrical skirt 16 extending along the central axis X from the platform 11. In other words, the skirt 16 extends from the upper face 12 of the platform 11, in this case orthogonally from the upper face 12. The skirt has an outer surface. Its connection to the platform is shaped like a circle. The rest of the platform 11 remains bare. The idea is to fill the entire volume of the insert 10 that surrounds the skirt 16, the platform 11 of which is bare.

Consequently, the insert 10 therefore includes an empty volume 17 defined by a base corresponding to a surface of the upper face 12 included between, on the one hand, the peripheral edge 13 and, on the other, a joint between the platform 11 and the outer surface of the skirt 16, and a height corresponding to the height of the skirt 16. The terms "base" and "height" are to be understood by their mathematical meaning, in particular by their geometric meaning. In other words, the empty space 17 is delimited by the skirt 16, the platform 11, the virtual side walls extending over the entire peripheral edge 13 of the platform 11 in a direction parallel with the axis X and over the entire height of the skirt 16, and a virtual upper wall covering the skirt 16 and the virtual side walls, and being identical to the platform 11.

According to the invention, the insert 10 further includes the filling means 18, 18', 19 of the empty volume 17. Therefore, when the insert 10 is inserted in the hollow body 1, the empty space remaining inside the hollow body is substantially occupied by the insert. This significantly reduces the hollow sound that would be heard if a user tapped the cover. Indeed, not only do the filling means 18, 18', 19 act as a barrier to the sound waves, they also absorb the sound waves, which produces a more pleasant "muffled" sound, rather than a hollow and loud noise that would be heard in their absence and in such a situation.

Preferably, the filling means 18, 18', 19 consist of a plurality of ribs 18, 18' extending from the outer surface of the skirt 16 and criss-crossing the volume 17, thereby filling it in a discontinuous manner.

Preferably, the filling means 18, 18', 19 consist also of two parallel and diametrically opposed walls 19. The parallel walls 19 extend radially from the outer surface of the skirt 16 along a plane intersecting with the axis X. The plane (located at the level of the A-A cross-section plane) is a plane of symmetry of the insert 10. The insert 10 has substantially the same configuration on either side of this plane.

Some of the ribs 18 extend radially from the parallel walls 19. Indeed, the parallel walls 19 maintain the alignment of the ribs 18, 18' over the entire width of the insert 10, regardless of the diameter of the skirt 16. The ribs 18, 18' are in the form of protrusions, the depth of which with respect to the outer surface of the skirt 16 and the parallel walls 19 varies. They can be substantially parallel with one another.

The terms "depth" of a rib 18, 18' is used herein to describe the distance between the joining edge of the rib with the outer surface of the skirt 16 or the parallel walls 19 and a free edge of the rib directed outwards from the insert 10. Advantageously, the ribs 18, 18' have an adequate depth inside the volume 17, i.e. they follow the limits of the volume 17. As is more visible in FIG. 3, the ribs 18 extending from the end of the parallel walls 19 are very short, whereas the ones extending from the same wall 19, but closer to the skirt 16, are longer. The important feature here is that the ribs 18, 18' do not extend beyond the limit established by the peripheral edge 13.

In the example shown in the figures, the ribs 18, 18' are oriented perpendicular to the plane of symmetry intersecting with the walls 19. The ribs 18, 18' extend from the skirt 16 and/or the parallel walls 19, preferably, substantially perpendicular to the upper face 12, i.e. in planes that are orthogonal to the upper face 12. They are parallel with one another. It should be noted that the orientation of the ribs 18, 18' is not limiting as it is the result of the manufacturing process of the insert 10. Indeed, the insert 10 is made of molded plastic. In this case, it is molded in a mold including two plates, each being associated with one of the faces of the insert, located on either side of the plane of symmetry. If there had been four plates instead of two, the orientation of the ribs 18, 18' might have been different. In that case, the ribs 18, 18' might have extended from the skirt 16 in four different directions and on every quadrant of a circle, and the ribs might have extended on the entire width of the insert 10, the parallel walls 19 therefore no longer being necessary. Furthermore, it should also be noted that the orientation of the ribs 18, 18' has no effect on the acoustic properties of the insert 10.

Figure 3:
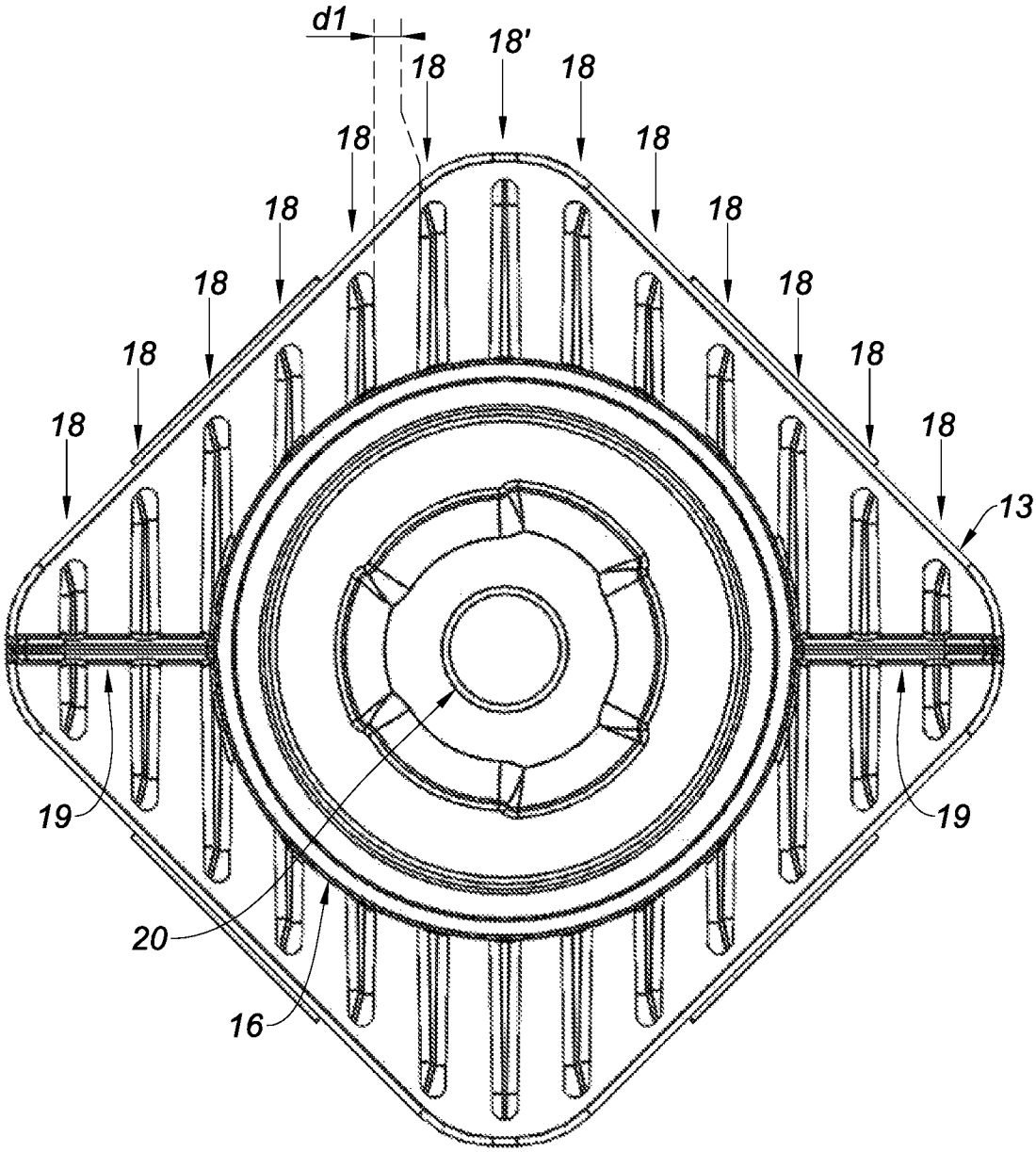
FIG. 3 is a top view of the insert of FIG. 1.

As shown in FIG. 3, the ribs 18, 18' are, preferably, evenly distributed around the skirt 16 and along the parallel walls 19. In other words, they can be distant from one another by a constant distance $d_1$. However, this distance $d_1$ does not necessarily have to be constant, although this facilitates the manufacturing process. Furthermore, it ensures that the cover features homogeneous acoustic properties.

Advantageously, the ribs 18, 18' are, two by two, spaced by a distance $d_1$ ranging from 2 to 4 mm. The shorter the distance $d_1$, the more there are obstacles to the propagation of the sound waves, and the louder sound waves will be muffled if someone were to tap on the cover, given a constant rib thickness. However, the distance must be at least 2 mm. Indeed, the empty space between the fins corresponds to the material of the mold, and this material must have a thickness of at least 2 mm to be machined to the required quality. So, because of machining constraints relating to the mold of the insert, the distance between the fins must not be shorter than 2 mm. In addition to the manufacturing constraints, $d_1$ is also a compromise between considerations in terms of costs, relating to the price of the material, and considerations relating to the acoustic properties of the end product.

Advantageously also, the ribs 18, 18' have a thickness ranging from 1 to 3 mm, preferably from 1.5 mm to 2.5 mm. The greater the thickness of the ribs 18, 18', the more there is available matter to absorb the sound waves, and the louder sound waves will therefore be muffled should someone tap on the lid, given a constant distance $d_1$. Furthermore, if the thickness is insufficient, i.e. less than 1 mm, the filling of the mold in the area of the ribs 18, 18' might prove tricky. On the other hand, if the fins are too thick, it would slow down the manufacturing process. Here again, the thickness range is a compromise between manufacturing constraints and considerations relating to the final acoustic properties of the end product.

Figure 4:
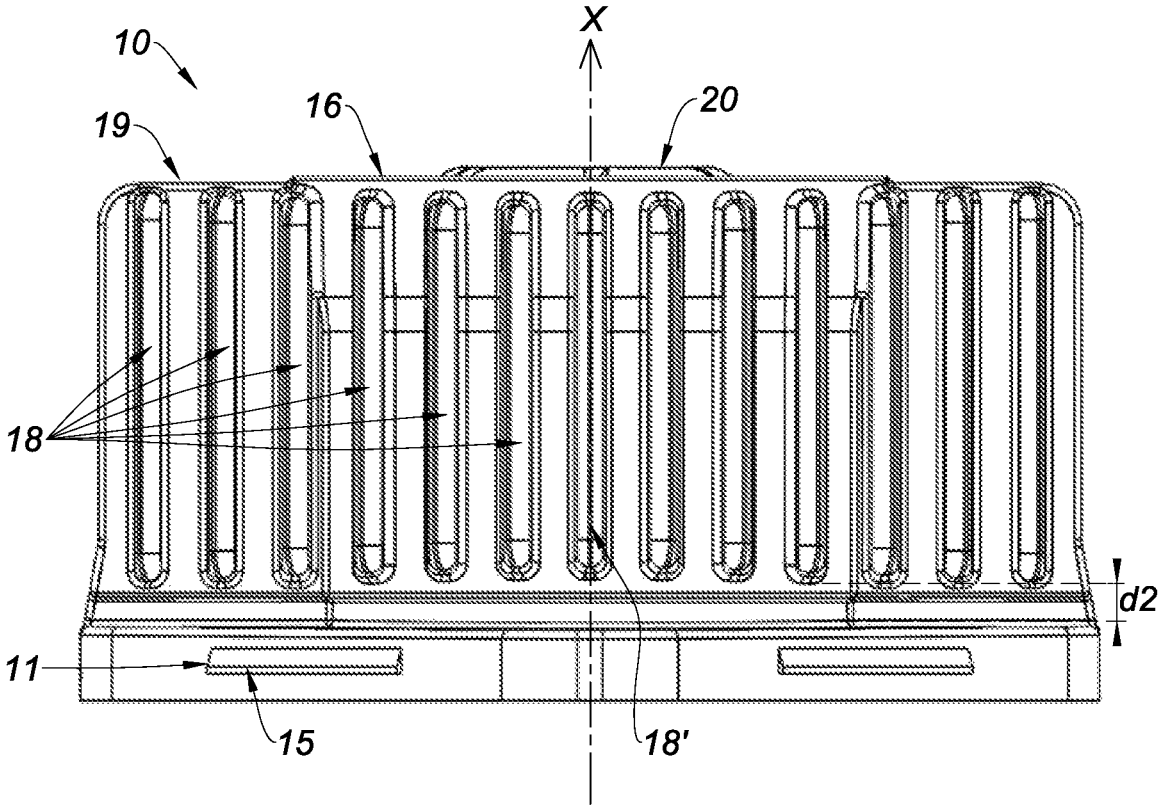
FIG. 4 is a front view of the insert of FIG. 1.

FIG. 4 shows that the ribs 18, 18' extend substantially and preferably over the entire height of the skirt 16. Obviously, the greater the height of the ribs 18, 18', the greater the filling rate of the volume 17, and louder sound waves will be more efficiently muffled if someone taps on the cover.

As is mentioned above, the filling means 18, 18' and 19 occupy a large portion of the empty space 17. The filling rate of the empty space 17 by the filling means 18, 18', 19 (i.e. the ribs and the walls), is preferably between 10% and 80%, and more preferably between 20% and 40%.

The filling means 18, 18', 19 are evenly distributed within the empty space 17, so as to balance the weight of the insert 10.

The filling means 18, 18', 19 extend amply in three dimensions within the empty volume 17 so as to come as close as possible to the virtual limits defining the empty volume 17. They are therefore slightly retracted with respect to the virtual limits. There is no interference with the cover 1 when it is placed on the insert 10.

Each rib 18, 18' and each wall 19 therefore has a dimension with a height that is practically equal to that of the skirt 16, and a depth that is practically equal to the depth separating the skirt 16 from the peripheral edge 13. In this manner, the edges of the ribs 18, 18' and of the walls 19 are proximal to the walls of the cover 1 when it is placed on the insert 10.

Incidentally, the filling means 18, 18', and 19 are structurally very different from known assembly means such as helical ribs, circumferential ribs, etc. constituting the thread of the cylindrical portions of the necks of the reservoirs on which is attached a pump element, a plug or any other means for sealing a reservoir. Indeed, although these ribs generally protrude from a cylindrical portion, they are of reduced depth along a longitudinal axis of the cylindrical portion. There can therefore not be considered as similar to the filling means 18, 18' and 19 of the invention. This is true in functional terms as well, as the filling means 18, 18' and 19 according to the invention absorb and act as a barrier to the sound waves coming from the cover when the user taps the cover with their finger, because of their aforementioned geometric properties, whereas the ribs of the prior art do not enable this, as they are too far from the wall of the cover.

Furthermore, the ribs 18, 18' are preferably distant from the platform 11 by a distance $d_2$. This distance $d_2$ prevents shrinkage cavities, i.e. aesthetic defects, from occurring on the lower face (not shown) of the platform 11 when the insert 10 is removed from its mold. It is worth remembering that the lower face of the platform 11 is the face that is visible to the user and must therefore feature aesthetic properties that reflect the value of the product contained in the vial.

Advantageously, the distance $d_2$ is between 2 and 7 mm, preferably between 4 and 6 mm. In particular, if the ribs 18, 18' extend all the way to the platform 11, there would be a risk of shrinkage cavities occurring on the platform. However, this distance must not be too long or else the advantage achieved by filling the volume 17 with the ribs 18, 18' would be lost.

Preferably, the parallel walls 19 are connected to the platform 11 by means of sections 19*a*. This provides the insert 10 with a good level of sturdiness and flexibility, which is particularly convenient during the assembly and/or disassembly of the cover. Preferably also, the sections 19*a* are tapered with respect to the parallel walls 19, i.e. they are less thin than the parallel walls. This thinning prevents shrinkage cavities from forming on the lower face of the platform when the insert 10 is being molded. More specifically, it is crucial to implement a certain ratio of the thickness of the tapered section 19*a* to the thickness of the platform 11 to achieve a completely smooth surface on the lower face of the platform 11, in particular as this face will be seen by the user.

As the insert 10 is molded as a single part, the control of these aesthetic defects is all the more important. Indeed, the entire insert 10 will have to be recycled if it has too many defects.

Preferably, the insert 10 includes a cylindrical conduit 20 extending from the platform 11 and featuring a central housing for receiving a pump (not shown). The housing is, evidently, formed with a central opening to enable the insertion of the pump. The pump is, in particular, part of the system for dispensing a fluid product arranged on the top part of the reservoir.

Figure 2:
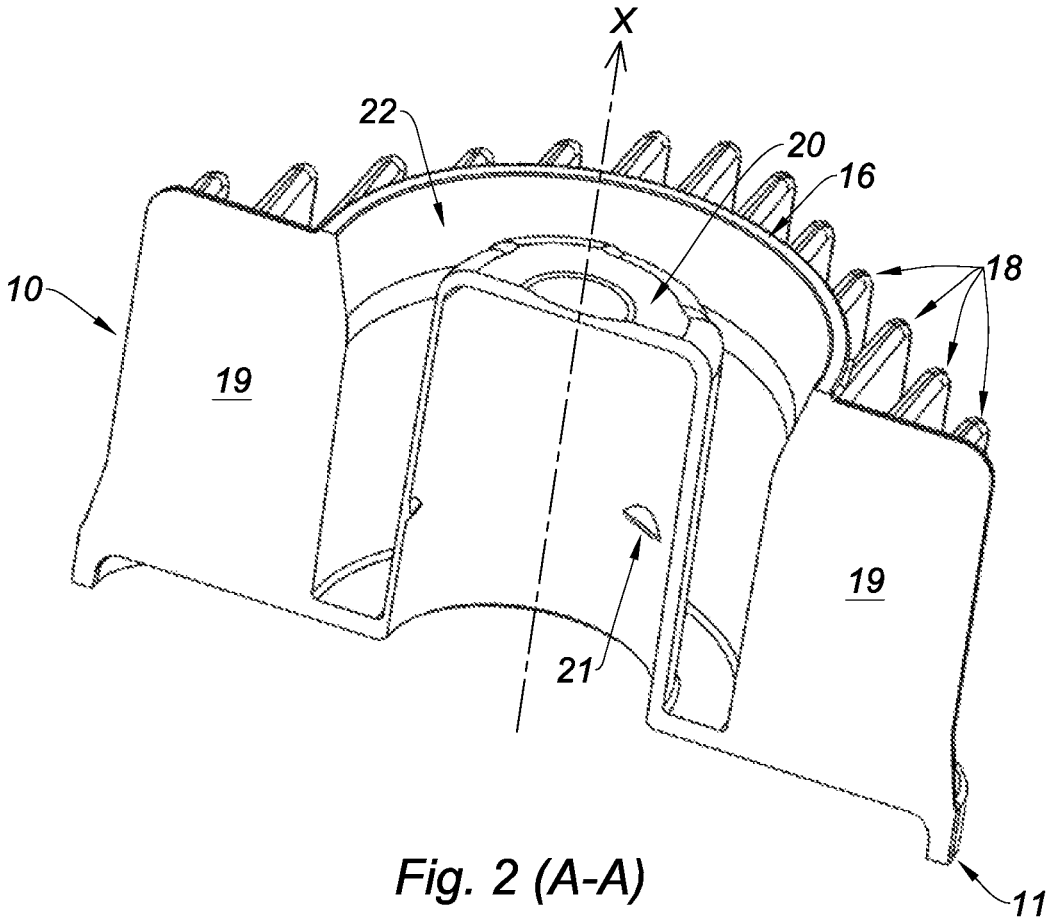
FIG. 2 is a perspective view along the A-A longitudinal cross-section of the insert of FIG. 1.

In the example shown, the conduit 20 is sealed at an upper free end. This, however, is not a mandatory feature. Furthermore, as is better seen in FIG. 2, the conduit 20 includes at least one notch 21 provided in the inner surface of its wall. The notch 21 advantageously attaches the pump to the wall of the conduit 20. Furthermore, it should be noted that the conduit 20 extends substantially over the entire height of the skirt 16. In other words, it has substantially the same height as the skirt 16. However, this is not a required feature.

The skirt 16 extends, preferably, coaxially around the conduit 20. Advantageously, a space 22 separates the skirt 16 from the conduit 20. This space 22 is configured to receive a weight element 25. The weight element 25 is not part of the insert 10. It is an element of the cover. During the assembly of the cover, the weight element 25 is housed between the conduit 20 and the skirt 16 of the insert, and the assembly is then inserted inside the hollow body 1.

Preferably, the weight element 25 is made of a high-density material. This weighs down the cover once it is assembled. Indeed, as mentioned above, the user associates the perceived value of the product contained in the vial with the weight of the cover. The weight element 25 is therefore particularly well adapted to achieve this purpose. For example, the weight element 25 can be made of steel or of Zamak.

Figure 5:
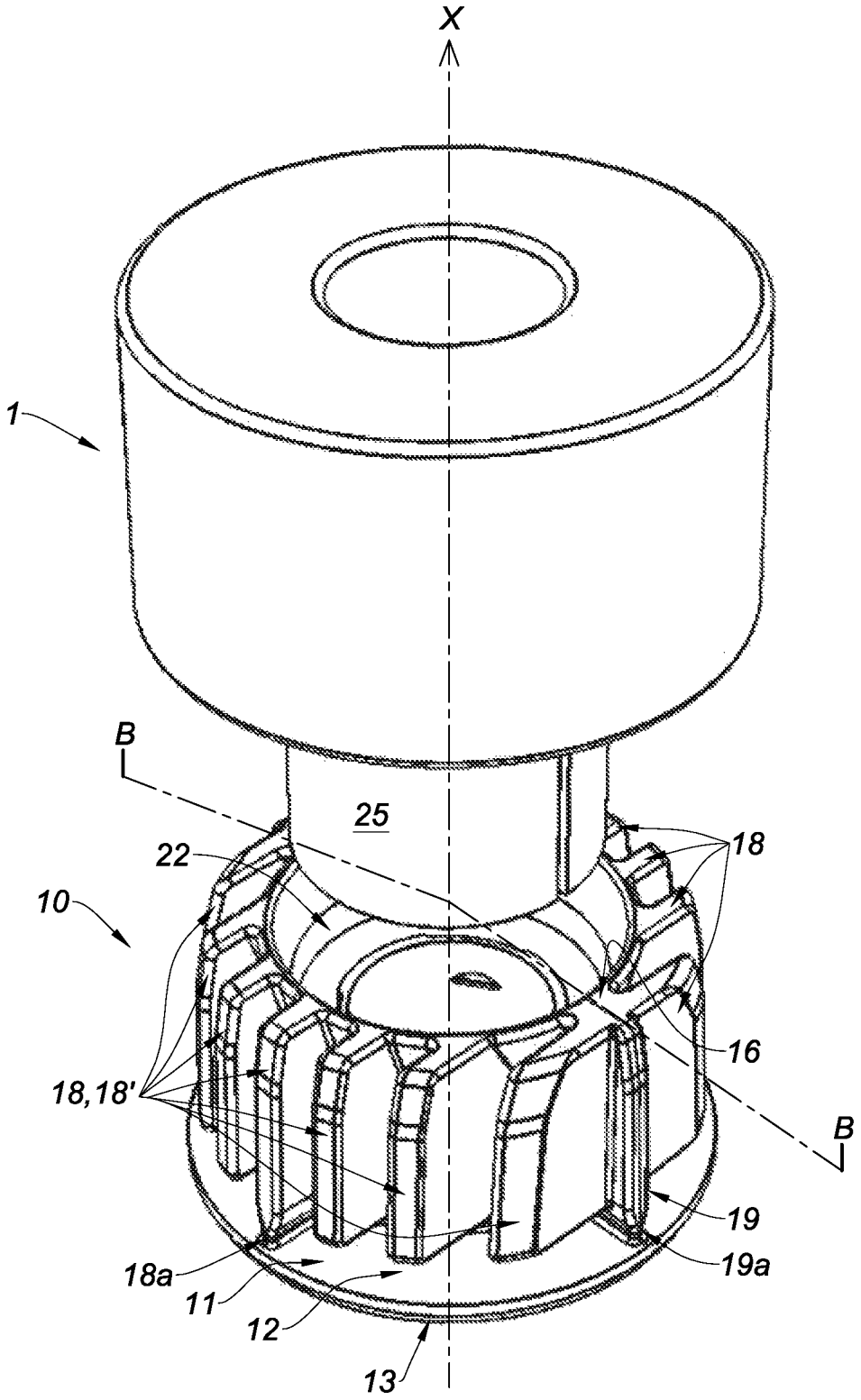
FIG. 5 is an exploded view of a cover according to a variant of the invention, including a hollow body, an insert and a weight element, in which the general aspect of the cover and of the insert is modified.
Figure 6:
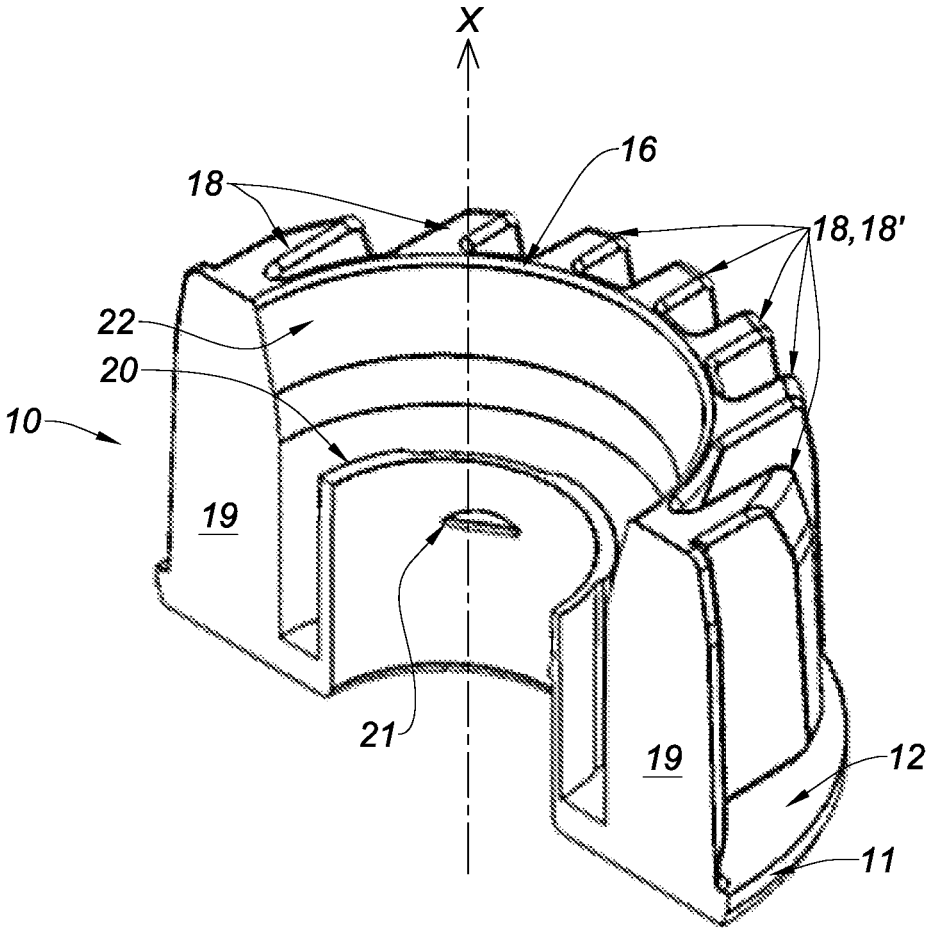
FIG. 6 is a view along the B-B longitudinal cross-section of the insert of FIG. 5.
Figure 7:
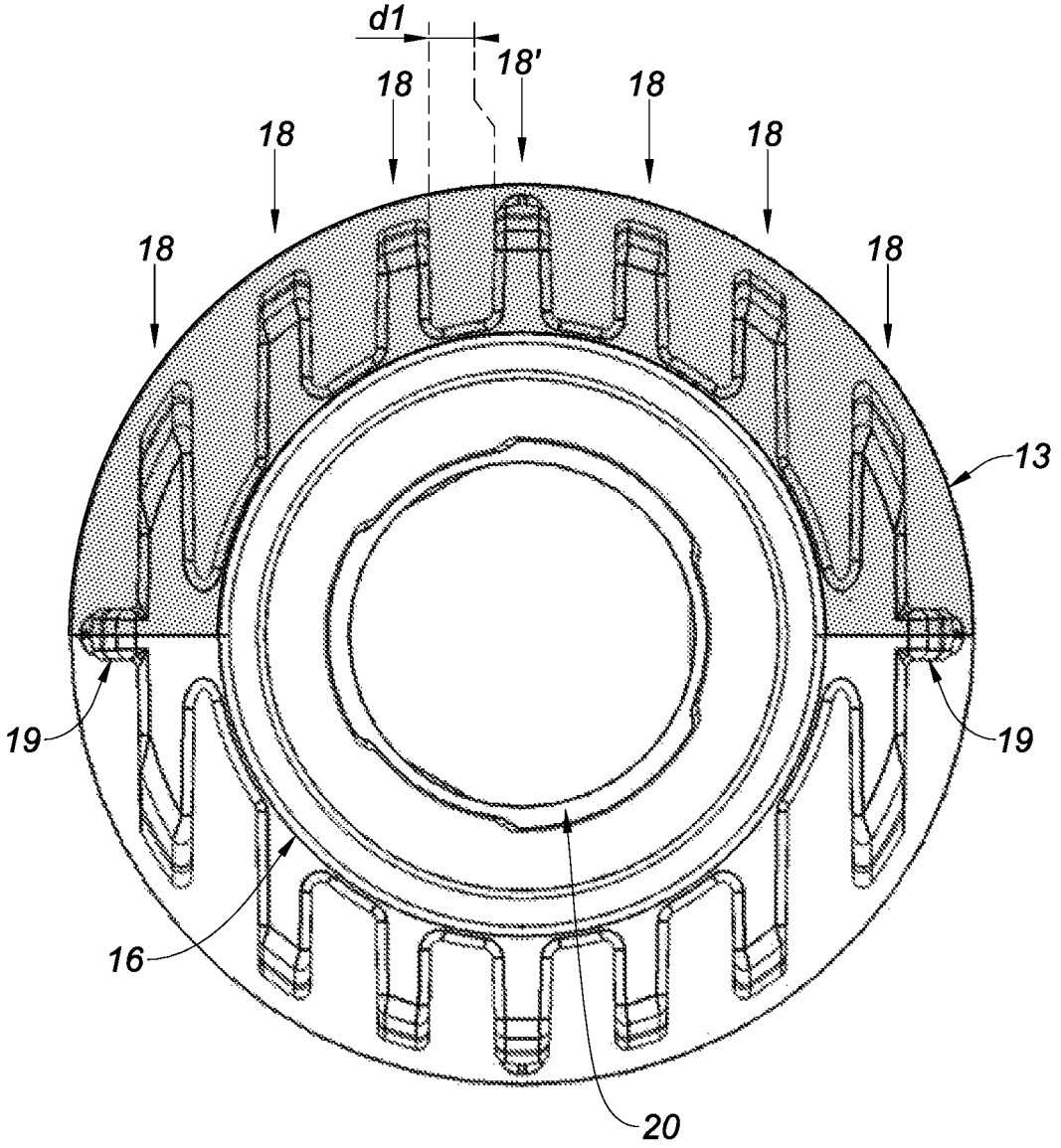
FIG. 7 is a top view of the insert of FIG. 5.

With reference to FIGS. 5 to 7, a cover according to the invention is shown according to a variant of the invention. The cover includes an insert 10 and a weight element 25. The cover is similar to the cover described above, and differs therefrom essentially in its general shape. It also differs in its conduit 20, which is described in the following sections.

In FIG. 5, the hollow body 1 is cylindrical. It includes an empty inner volume in which the insert 10 and the weight element 25 can be inserted.

Similarly to the cover described above, the insert 10 includes a platform 11 including an upper face 12 delimited by a peripheral edge 13 and having a central axis X, and a cylindrical skirt 16 extending along the central axis X from the platform. As can also be seen in FIG. 5, the peripheral edge 13 has a shape that fits with the outline of the hollow body 1.

The insert 10 also has means 18, 18', 19 for filling the empty volume 17 defined by a base corresponding to a surface of the upper face 12 included between, on the one hand, the peripheral edge 13 and, on the other, a joint between the platform 11 and the skirt 16, and a height corresponding to the height of the skirt 16. An inner periphery of this volume 17 is therefore circular in shape, as is the surface taken by the skirt 16 on the platform 11, whereas its outer periphery adopts the circular shape of the platform 11. The insert 10 is thus configured to absorb and act as a barrier to the sound waves that would occur when tapping the cover, which significantly reduces the louder sound waves within the cover.

Similarly to the configuration described above, the filling means 18, 18', 19 consist advantageously of ribs 18, 18'. These ribs 18, 18' have the same characteristics as the ribs described above. However, in the configuration shown here, these ribs can naturally differ from the ones described above in their depth, their thickness, their number, etc. In this example, they are thicker and in smaller numbers. Furthermore, they are less deep overall. Indeed, here the depth of the ribs 18, i.e. the distance separating their joining edge with the outer surface of the skirt 16 from their free edge does not change much, so as to fit optimally with the shape of the empty volume 17.

Advantageously, the filling means 18, 18', 19 consist also of two parallel walls 19 similar to those described above. However, it should be noted in FIG. 6 that they have a shorter extension in the longitudinal cross-section plane (B-B). Because of this reduced depth, only the ribs 18 extend from each face of each of the parallel walls 19. It should be understood therefore that this is simply the result of the general shape of the insert 10. It should also be noted that the parallel walls 19 are thicker, which enables, for the wall 19 visible in FIG. 5, to see its delimitation with the tapered section 19*a*.

Preferably, the ribs 18' located at 90° from the parallel walls 19 are also connected to the platform 11 by a tapered section 18*a*. This tapered section 18*a* has a reduced thickness with respect to that of the rib 18' to which it is attached. The tapered section 18*a* improves the sturdiness of the insert 10, while retaining flexibility, similarly to the section 19*a*.

The insert 10 includes, in this case too, a cylindrical conduit 20 extending from the platform 11 and featuring a central housing for receiving a pump (not shown). As is more visible in FIG. 6, the housing is formed with a central opening to enable the insertion of the pump. Unlike the preceding configuration, the conduit 20 remains open at its upper free end.

Here again, the conduit 20 is distant from the skirt 16 by a sufficient space to house a weight element 25. The latter has the same properties as described above. However, its diameter and/or height can vary substantially.

The configurations shown in the mentioned figures are only some of the possible examples of the invention, which is not limited thereto, as the invention includes the variants of shapes and designs that are within the scope of the person skilled in the field.

Of note, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", and/or "including," when used in this specification, specify the presence of stated features, integers, steps, operations, elements, and/or components, but do not preclude the presence or addition of one or more other features, integers, steps, operations, elements, components, and/or groups thereof.

As well, the corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

1. A vial cover for closing a vial for dispensing a fluid product, said vial cover comprising a hollow body and an insert inserted in the hollow body, said insert comprising:

a platform comprising an upper face delimited by a peripheral edge and featuring a central axis;

a skirt extending along the central axis from the platform and featuring an outer surface;

an empty volume defined by a base corresponding to a surface of the upper face comprised between, on the one hand, the peripheral edge and, on the other, a joint between the platform and the outer surface of the skirt, and a height corresponding to the height of the skirt;

the insert further comprising the means for filling the empty volume, said means for filling the empty volume consist of ribs that extend from the outer surface of the skirt;

said means for filling the empty volume generally consist of two parallel and diametrically opposed walls that extend radially from the outer surface of the skirt along a plane intersecting on the axis with a plurality of ribs extending from said parallel walls and the ribs are evenly distributed over the entire periphery of the skirt and along the parallel walls.

2. The vial cover according to claim 1, wherein the ribs are parallel with one another.

3. The vial cover according to claim 1, wherein the ribs are separated from the platform.

4. The vial cover according to claim 1, wherein two ribs are located at 90° of said parallel walls and are attached to the platform through a tapered section.

5. The vial cover according to claim 1, wherein the ribs extend over the entire length of the skirt.

6. The vial cover according to claim 1, wherein the parallel walls extend from the platform through a tapered section.

7. The vial cover according to claim 1, comprising a cylindrical conduit extending from the platform and featuring a central housing able to receive a pump, said skirt extending coaxially around said conduit.

8. The vial cover according to claim 7, wherein said conduit has the same height as the skirt.

9. The vial cover according to claim 7, wherein said conduit is sealed at its free upper end.

10. The vial cover according to claim 1, wherein the cover is moulded as a single part.

11. The vial cover according to claim 1, wherein a filling rate of the empty volume by the filling means ranges from 10% to 80%.

12. A vial for dispensing a fluid product equipped with a cover comprising:

a platform comprising an upper face delimited by a peripheral edge and featuring a central axis;

a skirt extending along the central axis from the platform and featuring an outer surface;

an empty volume defined by a base corresponding to a surface of the upper face comprised between, on the one hand, the peripheral edge and, on the other, a joint between the platform and the outer surface of the skirt, and a height corresponding to the height of the skirt;

the insert further comprising the means for filling the empty volume, said means for filling the empty volume consist of ribs that extend from the outer surface of the skirt, said means for filling the empty volume generally consist of two parallel and diametrically opposed walls that extend radially from the outer surface of the skirt along a plane intersecting on the axis with a plurality of ribs extending from said parallel walls and the ribs are evenly distributed over the entire periphery of the skirt and along the parallel walls.

* * * * *